US010731526B2

(12) United States Patent
Lahr

(10) Patent No.: US 10,731,526 B2
(45) Date of Patent: Aug. 4, 2020

(54) ENGINE BRAKE DEVICE FOR AN INTERNAL COMBUSTION ENGINE

(71) Applicant: Daimler AG, Stuttgart (DE)

(72) Inventor: Matthias Lahr, Schwaebisch Gmuend (DE)

(73) Assignee: Daimler AG, Stuttgart (DE)

( * ) Notice: Subject to any disclaimer, the term of this patent is extended or adjusted under 35 U.S.C. 154(b) by 878 days.

(21) Appl. No.: 15/315,541

(22) PCT Filed: May 23, 2015

(86) PCT No.: PCT/EP2015/001063
§ 371 (c)(1),
(2) Date: Dec. 1, 2016

(87) PCT Pub. No.: WO2015/185189
PCT Pub. Date: Dec. 10, 2015

(65) Prior Publication Data

US 2018/0142585 A1 May 24, 2018

(30) Foreign Application Priority Data

Jun. 5, 2014 (DE) ..... 10 2014 008 378

(51) Int. Cl.

| | |
|---|---|
| ***F01L 13/06*** | (2006.01) |
| ***F01L 1/18*** | (2006.01) |
| ***F01L 13/08*** | (2006.01) |
| ***F02D 13/04*** | (2006.01) |
| ***F01L 1/38*** | (2006.01) |
| *F01L 1/047* | (2006.01) |

(52) U.S. Cl.
CPC ..... *F01L 13/065* (2013.01); *F01L 1/182* (2013.01); *F01L 1/38* (2013.01); *F01L 13/08* (2013.01);
(Continued)

(58) Field of Classification Search
CPC ..... F01L 13/0036; F01L 13/06; F01L 13/065; F01L 13/08; F01L 1/18; F01L 1/182;
(Continued)

(56) References Cited

U.S. PATENT DOCUMENTS 5,809,952 A * 9/1998 Ono ..... F01L 1/181 123/182.1
8,201,530 B2 * 6/2012 Talan ..... F01L 13/0036 123/90.18
(Continued)

FOREIGN PATENT DOCUMENTS

CN 103334807 A 10/2013
DE 577 588 A 6/1933
(Continued)

OTHER PUBLICATIONS

PCT/EP2015/001063, International Search Report dated Sep. 18, 2015 (Three (3) pages).
(Continued)

*Primary Examiner* — Mark A Laurenzi
*Assistant Examiner* — Loren C Edwards
(74) *Attorney, Agent, or Firm* — Crowell & Moring LLP

(57) ABSTRACT

An engine brake device is disclosed. The engine brake device includes at least one intake camshaft which includes at least one intake cam group having at least one firing cam and at least one braking cam, at least one intake cam follower that is assigned to the firing cam and is provided for actuating at least one intake valve in a firing mode, at least one braking intake cam follower that is assigned to the braking cam and is provided for actuating the at least one intake valve in a braking mode, and a switchover device that is assigned to the intake camshaft and is provided for the
(Continued)

purpose of translating a torque of the intake camshaft into a force for switching between the firing mode and the braking mode.

8 Claims, 8 Drawing Sheets

(52) U.S. Cl.
CPC ..... *F02D 13/04* (2013.01); *F01L 2001/0473* (2013.01); *F01L 2105/00* (2013.01)

(58) Field of Classification Search
CPC .. F01L 1/053; F01L 1/08; F02D 13/04; F02D 9/06
USPC ..... 123/90.11, 90.15, 90.16, 90.17
See application file for complete search history.

(56) References Cited

U.S. PATENT DOCUMENTS 8,474,424 B2 * 7/2013 Meintschel ..... F01L 13/0036 123/90.18
8,584,632 B2 11/2013 Stiegler et al.
2006/0005796 A1 1/2006 Janak et al.
2009/0071436 A1 * 3/2009 Dietrich ..... F01L 13/06 123/321
2014/0251266 A1 * 9/2014 Emmons ..... F02D 13/04 123/321

FOREIGN PATENT DOCUMENTS

DE 10 2007 048 915 A1 4/2009
DE 10 2011 101 871 A1 11/2012
EP 1 042 598 B1 10/2000
EP 2 191 106 B1 6/2010
WO WO 2012/038191 A1 3/2012
WO WO 2015/070949 A1 5/2015

OTHER PUBLICATIONS

German Search Report issued in German counterpart application No. 10 2014 008 378.0 dated Jul. 24, 2014, with Statement of Relevancy (Nine (9) pages).

* cited by examiner

ENGINE BRAKE DEVICE FOR AN INTERNAL COMBUSTION ENGINE

BACKGROUND AND SUMMARY OF THE INVENTION

The invention relates to an engine brake device for an internal combustion engine of a motor vehicle, in particular of a commercial vehicle.

An engine brake device is already known from EP 2 191 106 B1, comprising a camshaft, which includes at least one cam group having at least one firing cam and at least one braking cam, further comprising at least one cam follower that is assigned to the firing cam and provided for actuating at least one gas exchange valve in the firing mode, and a cam follower that is assigned to the braking cam and provided for actuating the at least one gas exchange valve in a braking mode, and comprising a switchover device, which is provided for switching between the firing mode and the braking mode.

It is in particular the object of the invention to provide a cost-effective engine brake device having a high engine braking power.

According to the invention, an engine brake device is provided, comprising at least one intake camshaft, which includes at least one intake cam group having at least one firing cam and at least one braking cam, further comprising at least one intake cam follower that is assigned to the firing cam and provided for the purpose of actuating at least one intake valve in a firing mode, at least one braking intake cam follower that is assigned to the braking cam and provided for actuating the at least one intake valve in a braking mode, and comprising a switchover device that is assigned to the intake camshaft and provided for the purpose of translating a torque of the intake camshaft into a force for switching between the firing mode and the braking mode. In this way, a torque and/or a rotational movement of the intake camshaft can be utilized to selectively actuate the at least one intake valve for the firing mode or for the braking mode, whereby the at least one intake valve can be actuated in the braking mode, and an engine braking power can thereby be increased, in a cost-effective and space-saving manner, in addition to a braking mode of at least one exhaust valve of the engine brake device. In this way, it is possible to achieve two intake strokes within one cycle, for example in a four-cycle engine, whereby retarding compression work of the four-cycle engine can be increased by the compression of combustion air that is pulled in and subsequent decompression, without using this air, per cycle. By utilizing the torque and/or the rotational movement of the intake camshaft for switching the actuation of the at least one intake valve, actuators, which provide the force for the switchover, for example in the form of hydraulic pressure, can be dispensed with, whereby the torque and/or the rotational movement of the intake camshaft can be used directly for the switchover process. As a result, additional actuators can be dispensed with, which typically generate additional drag torque, thus allowing an efficiency of an internal combustion engine comprising such an engine brake device to be increased. In this way, in particular a fuel consumption of the internal combustion engine can be reduced. By dispensing with corresponding actuators that directly provide a force for the switchover, in this way, however, a quantity and/or a complexity of actuators can be reduced, whereby a particularly cost-effective embodiment can be achieved. As a result, a cost-effective engine brake device having a high engine braking power can be provided and/or the consumption of the internal combustion engine comprising the engine brake device can be reduced. An "intake cam group" shall be understood to mean a group of intake cams that includes all the intake cams which are provided for one working cylinder of the internal combustion engine and which the intake camshaft comprises. A "firing mode" in this connection shall in particular be understood to mean an activation of the at least one intake valve for a fired operation of the at least one working cylinder during which compression work inside the at least one working cylinder is used in particular for driving purposes. A "braking mode" in this connection shall in particular be understood to mean an activation of the at least one intake valve for a braking operation of the at least one working cylinder during which the compression work inside the at least one working cylinder is used for braking purposes. The firing mode and the braking mode differ from one another in particular with respect to the activation times for the at least one intake valve. A "switchover device assigned to the intake camshaft" in this connection shall in particular be understood to mean a mechanism that is provided for switching between the firing mode and the braking mode of the at least one intake valve. The term "provided" shall be understood in particular as specially designed, configured, equipped and/or disposed.

It is furthermore proposed that the switchover device assigned to the intake camshaft comprises at least one gate element that is non-rotatably but axially displaceably connected to the intake camshaft and has at least one slotted guide track, which is provided for the purpose of translating a rotational movement of the intake camshaft into a linear shifting movement of the gate element. In this way, the rotational movement, and thus the torque, of the intake camshaft can be used in a simple manner to switch the gate element between two shift positions. The mechanical switch of the gate element can then be converted into a switchover between the firing mode and the braking mode of the at least one intake valve, whereby the switchover device can be implemented using solely mechanical components. An actuator required for triggering the switchover can then be designed in the form of a simple electrical or electromagnetic actuator.

The engine brake device preferably comprises an actuator, which is disposed in a stationary manner with respect to the gate element of the switchover device assigned to the intake camshaft and comprises at least one shifting pin, which is provided for the purpose of engaging in the at least one slotted guide track and translating the rotational movement of the intake camshaft into the linear shifting movement of the gate element. The actuator can thus have a simple and cost-effective design. In particular, the actuator must only be provided to cause the shifting pin to engage in the shifting gate. A shifting force necessary for this purpose is considerably smaller than a supporting force that is necessary when the actuator switches directly between the firing mode and the braking mode, for example by acting directly on the intake cam follower. The actuator only has to be energized for the switchover process between the firing mode and the braking mode of the at least one intake valve. An actuator that must be permanently active during the braking mode and/or the firing mode so as to maintain the firing mode or the braking mode of the at least one intake valve can be eliminated.

Moreover, it is proposed that the engine brake device comprises at least two rocker arms, which each include one of the intake cam followers and can each be pivoted about a rocker arm axis for actuating the at least one intake valve, wherein the switchover device assigned to the intake camshaft comprises a rocker arm mounting that establishes the rocker arm axis and has a first end position assigned to the firing mode and a second braking end position assigned to the braking mode. The switchover between the firing mode and the braking mode of the at least one intake valve can thus be easily implemented in a mechanical manner, without the switchover device assigned to the intake camshaft requiring a further actuator, whereby a simple and robust switchover device can be implemented. As a result of such an embodiment, it can furthermore be achieved that the end position of the rocker arm mounting establishes whether the firing mode or the braking mode of the at least one intake valve is being activated, whereby, for the purpose of switchover, the rocker arm mounting only has to be switched from the one end position into the other end position. A "rocker arm mounting" shall in particular be understood to mean a mounting for rocker arms for actuating the at least one intake valve, which is provided to absorb and dissipate actuating forces acting on the rocker arms during an actuation of the at least one intake valve. By joining the rocker arms to the rocker arm mounting switchable between the first end position and the second end position, it is possible to achieve that, depending on the end position, the one rocker arm or the other rocker arm is operatively connected to the intake camshaft, whereby it is easily possible to switch between the firing mode and the braking mode of the at least one intake valve.

The rocker arm mounting is preferably provided so as to be switchable between the two end positions by way of the torque of the intake camshaft. The torque of the intake camshaft can thus be advantageously used, whereby high efficiency can be achieved. The actuating forces acting on the rocker arms during an actuation of the at least one intake valve are preferably dissipated on the rocker arm mounting in such a way that a torque acts, which can be used for shifting from the one end position into the other end position.

The switchover device assigned to the intake camshaft advantageously comprises at least one detent engagement element loaded by a spring force, which is provided for the purpose of fixing the rocker arm mounting in the two end positions. In this way, it is possible to support actuating forces acting on the rocker arm mounting in the firing mode and the braking mode of the at least one intake valve, without the need for an actuator to remain permanently active for this purpose, whereby particularly high efficiency can be achieved.

Moreover, it is proposed that the switchover device assigned to the intake camshaft comprises at least one movably mounted detent contour element, against which the at least one detent engagement element of the rocker arm mounting is supported. By movably mounting the detent contour element, it is easily possible to release the fixation of the rocker arm mounting in the end positions thereof. At the same time, it is possible to achieve that forces necessary for releasing the detent engagement element can be considerably smaller than forces that can be supported by the detent engagement element for the fixation of the rocker arm mounting. The rocker arm mounting can thus be fixed against high actuating forces by way of the detent engagement element, while also allowing the fixation of the rocker arm mounting to be easily released.

It is furthermore advantageous if the detent contour element of the switchover device assigned to the intake camshaft has at least two locking positions, and the gate element is provided for the purpose of pivoting the at least one detent contour element from the locking positions at least into one intermediate position between the locking positions. The torque and the rotational movement of the intake camshaft can thus be utilized to release the fixation of the rocker arm mounting, whereby the entire switchover process between the firing mode and the braking mode of the at least one intake valve is effectuated by the torque and the rotational movement of the intake camshaft, and the actuator of the engine brake device is only provided to trigger the switchover process.

Moreover, it is proposed that the gate element of the switchover device assigned to the intake camshaft has two shift positions and comprises an actuating pin, which is provided for the purpose of shifting the at least one detent contour element from the first locking position into the intermediate position in the first switched position, and from the second locking position into the intermediate position in the second shift position. This allows the gate element to be mechanically coupled particularly easily to the detent contour element, whereby it is possible in particular to achieve that the switchover of the detent contour element takes place in a defined intake camshaft position, whereby the entire switchover process can be adapted to an intake cam curve of the braking cam and/or of the firing cam of the intake cam group.

To provide a high engine braking power, it is in particular advantageous if the at least one braking cam of the intake cam group has at least two intake elevations, whereby the at least one intake valve can be actuated at least twice during one intake camshaft rotation so as to take in air.

To save costs, it is furthermore advantageous if the braking rocker arm, which comprises the braking intake cam follower assigned to the braking cam, is provided for the purpose of actuating the rocker arm that comprises the intake cam follower assigned to the firing cam. The at least one intake valve can thus be actuated by the braking rocker arm, which comprises the braking intake cam follower assigned to the braking cam, via the rocker arm that comprises the intake cam follower assigned to the firing cam, whereby a design complexity can be minimized.

It is furthermore advantageous if the engine brake device comprises at least one exhaust camshaft, which includes at least one exhaust cam group having at least one firing cam and at least one braking cam, at least one exhaust cam follower that is assigned to the firing cam and provided for the purpose of actuating at least one exhaust valve in a firing mode, at least one braking exhaust cam follower that is assigned to the braking cam and provided for the purpose of actuating the at least one exhaust valve in a braking mode, and a switchover device that is assigned to the exhaust camshaft and provided for the purpose of translating a torque of the exhaust camshaft into a force for switching between the firing mode and the braking mode. In this way, a torque and/or a rotational movement of the exhaust camshaft can be utilized to selectively actuate the at least one exhaust valve for the firing mode or for the braking mode, whereby, for the purpose of providing the engine braking power, the braking mode of the at least one exhaust valve can be activated in a cost-effective and space-saving manner so as to decompress compressed air in the working cylinder without using the same. The switchover device assigned to the exhaust camshaft is preferably designed analogously to the switchover device assigned to the intake camshaft. An actuation of the switchover device assigned to the exhaust camshaft preferably takes place analogously to the actuation of the switchover device assigned to the intake camshaft. An actuation of the at least one exhaust valve and/or an implementation of the braking mode and of the firing mode of the at least one exhaust valve preferably take place analogously to the at least one intake valve. The at least one intake valve and the at least one exhaust valve are advantageously assigned to the at least one working cylinder, which can be operated in fired operation and in braking operation. In the fired operation of the at least one working cylinder, preferably the at least one intake valve and the at least one exhaust valve are each actuated in the firing mode thereof. In the braking operation of the at least one working cylinder, preferably the at least one intake valve and the at least one exhaust valve are each actuated in the braking mode thereof. In principle, however, it is conceivable that the at least one exhaust valve is actuated in the braking mode thereof and the at least one intake valve is actuated in the firing mode thereof, in the braking operation of the at least one working cylinder. An "exhaust cam group" shall be understood to mean a group of exhaust cams that includes all the exhaust cams provided for one working cylinder of the internal combustion engine which the exhaust camshaft comprises. A "firing mode" in this connection shall in particular be understood to mean an activation of the at least one exhaust valve for the fired operation of the at least one working cylinder during which the compression work inside the at least one working cylinder is used in particular for driving purposes. A "braking mode" in this connection shall in particular be understood to mean an activation of the at least one exhaust valve for a braking operation of the at least one working cylinder during which the compression work inside the at least one working cylinder is used for braking purposes. The firing mode and the braking mode differ from one another in particular with respect to the activation times for the at least one exhaust valve. A "switchover device assigned to the exhaust camshaft" in this connection shall in particular be understood to mean a mechanism that is provided for switching between the firing mode and the braking mode of the at least one exhaust valve.

In an advantageous embodiment, the switchover device assigned to the exhaust camshaft and the switchover device assigned to the intake camshaft can be activated independently of one another, whereby the braking operation of the at least one working cylinder can be selectively set by actuating the at least one exhaust valve and the at least one intake valve in the braking mode, or only by actuating the at least one exhaust valve. The actuation of the at least one exhaust valve and of the at least one intake valve in the braking mode for the braking operation of the at least one working cylinder, or the actuation of only the at least one exhaust valve in the braking mode for the braking operation of the at least one working cylinder, can essentially be set as a function of at least one parameter, in particular at least one driving state parameter and/or a road condition parameter, such as a vehicle speed and/or a negative grade of a road, preferably automatically by way of an open-loop and/or closed-loop control unit by the corresponding actuation of the switchover devices.

It is furthermore proposed that the engine brake device comprises at least one further braking exhaust cam follower, wherein the at least one exhaust cam group comprises at least one further braking cam, and the further braking exhaust cam follower for actuating at least one further exhaust valve in a braking mode is assigned to the further braking cam. In this way, it is possible for the at least two exhaust valves to be actuated independently of one another, whereby the actuation of the exhaust valves can be advantageously adapted to certain requirements, such as a high opening cross-section or low load, for example.

It is furthermore proposed that the at least two braking cams of the exhaust cam group have differing exhaust cam curves. In this way, actuations of the exhaust valves can differ from one another, whereby the actuations of the exhaust valves can be adapted to one another.

A further idea according to the invention proposes a valve train device comprising at least one intake camshaft, which includes at least one intake cam group having at least one first intake cam and at least one second intake cam, at least one intake cam follower that is assigned to the first intake cam and provided for actuating at least one intake valve in a first mode, and an intake cam follower that is assigned to the second intake cam and provided for actuating the at least one intake valve in a second mode, and a switchover device that is assigned to the intake camshaft and provided for the purpose of switching between the first mode and the second mode, wherein the switchover device assigned to the intake camshaft is provided for the purpose of translating a torque of the intake camshaft into a force for switching between the first mode and the second mode. It is furthermore advantageous if the valve train device comprises at least one exhaust camshaft, including at least one exhaust cam group having at least one first exhaust cam and at least one second exhaust cam, at least one exhaust cam follower that is assigned to the first exhaust cam and provided for the purpose of actuating at least one exhaust valve in a first mode, and an exhaust cam follower that is assigned to the second exhaust cam and provided for the purpose of actuating the at least one exhaust valve in a second mode, and a switchover device that is assigned to the exhaust camshaft and provided for the purpose of switching between the first mode and the second mode, wherein the switchover device assigned to the exhaust camshaft is provided for the purpose of translating a torque of the exhaust camshaft into a force for switching between the first mode and the second mode. Further possible embodiments correspond in particular to the dependent claims.

In principle, the switchover device can also be used in conjunction with other valve trains. For example, the switchover device may also be provided for switching between a part-load operation and a full-load operation, instead of switching between a firing mode and a braking mode. It is likewise conceivable to provide the switchover device for switching between a firing mode and a decompression mode, for example to increase comfort during a start and a stop of an internal combustion engine. When switching between a firing mode and a decompression mode by way of the switchover device during a stop or shut-down of the internal combustion engine, the decompression mode can advantageously remain set, so that during a renewed start of the internal combustion engine the switchover device is already switched to a decompression mode, whereby a comfortable start of the internal combustion engine without delay is made possible. It is furthermore conceivable to provide the switchover device for cylinder deactivation so that, for the deactivation of at least one working cylinder, all gas exchange valves assigned to this at least one working cylinder remain non-actuated.

Further advantages will be apparent from the following description of the figures. The figures show one exemplary embodiment of the invention. The figures, description of the figures, and claims contain numerous features in combination. A person skilled in the art will advantageously also consider these features individually and combine them into useful further combinations.

DETAILED DESCRIPTION OF THE DRAWINGS

Figure 1:
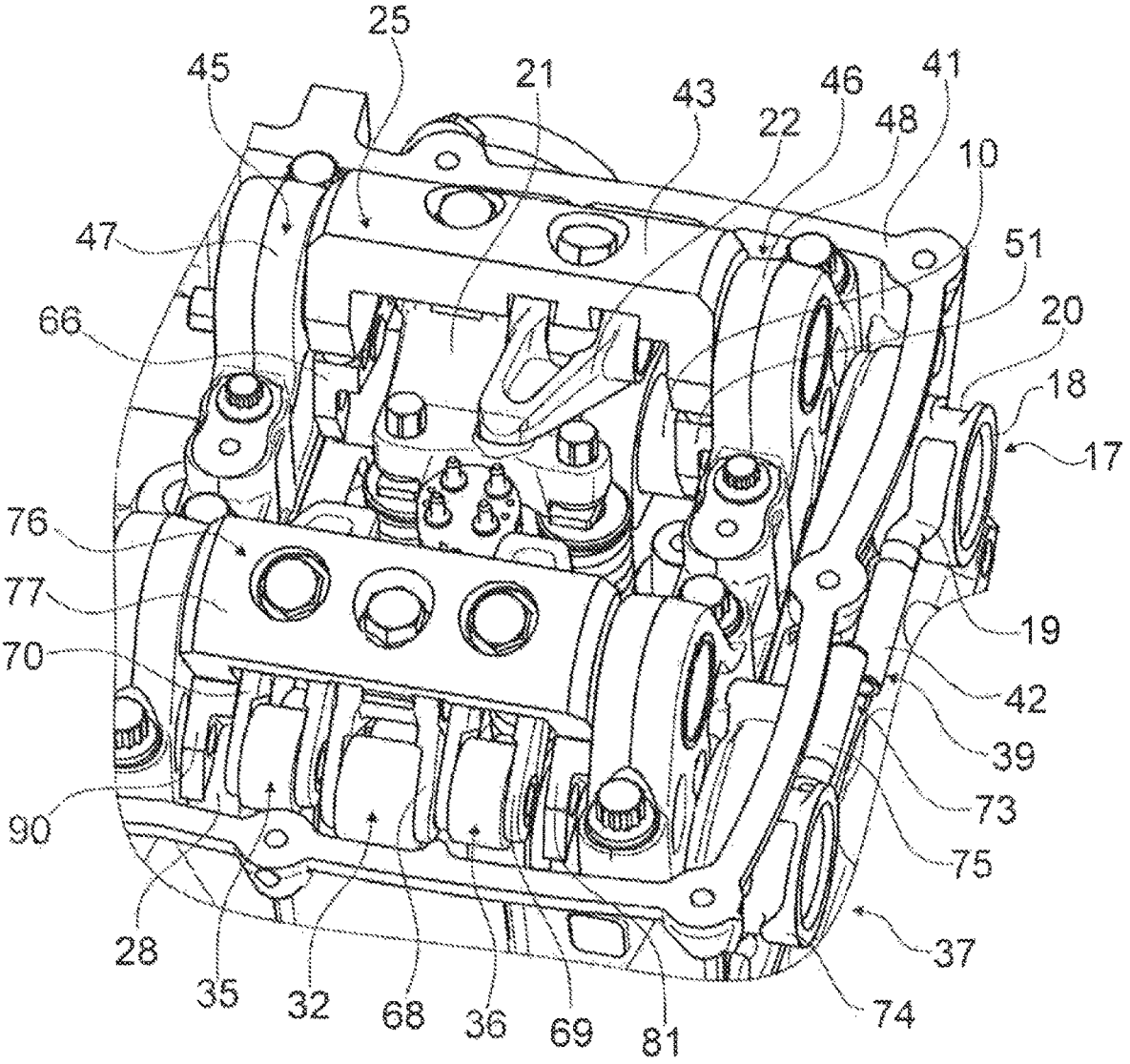
FIG. 1 shows a partial perspective view of an internal combustion engine, comprising a valve train device including an integrated engine brake device.

FIGS. 1 to 8 show a portion of an internal combustion engine of a commercial vehicle. The internal combustion engine comprises a valve train device having a valve train and an integrated engine brake device for the internal combustion engine. The valve train device comprises an intake side including an intake camshaft 10 and an exhaust side including an exhaust camshaft 28, which are each provided for a firing mode and a braking mode. The intake camshaft 10 is provided to actuate intake valves 14, 15 for working cylinders of the internal combustion engine, the working cylinders not being shown in detail. The exhaust camshaft 28 is provided to actuate exhaust valves 33, 34 for working cylinders of the internal combustion engine, the working cylinders not being shown in detail. The working cylinders can be operated in a fired operation, in which the firing mode of the intake camshaft 10 and of the exhaust camshaft 28 is set, and in a braking operation, in which the braking mode of the intake camshaft 10 and of the exhaust camshaft 28 is set. In the fired operation, a crankshaft is driven by virtue of a combustion process in the working cylinders, and in the braking operation, the crankshaft is decelerated by virtue of an unused compression of compression air in the working cylinders. The internal combustion engine is designed as a four-stroke engine.

In the shown exemplary embodiment, the internal combustion engine comprises two intake valves 14, 15 and two exhaust valves 33, 34 for each working cylinder. The intake camshaft 10 comprises an intake cam group for each working cylinder for actuating the two intake valves 14, 15, and the exhaust camshaft 28 comprises an exhaust cam group for each working cylinder for actuating the two exhaust valves 33, 34. The exemplary embodiment shows only one of the intake cam groups and one of the exhaust cam groups. Further intake cam groups, which are not shown in detail and provided for actuating the intake valves of the further working cylinders, are designed analogously. Further exhaust cam groups, which are not shown in detail and provided for actuating the exhaust valves of the further working cylinders, are designed analogously. Hereafter, first the intake side is described, and then the exhaust side.

The intake cam group comprises a first firing cam 11, which is provided for the purpose of opening the intake valves 14, 15 in the firing mode, and a second braking cam 12, which is provided for the purpose of opening the intake valves 14, 15 in the braking mode. The firing cam 11 and the braking cam 12 have differing intake cam curves. The intake cam curve of the firing cam 11 has an intake elevation 38, which is provided in particular for the purpose of opening the intake valves 14, 15 while a piston is being moved from top dead center to bottom dead center in the appropriate working cylinder to draw combustion air into the working cylinder. The braking intake cam curve of the braking cam 12 has two intake elevations 26, 27, which are each provided in particular for the purpose of opening the intake valves 14, 15 while the piston is being moved from top dead center to bottom dead center in the appropriate working cylinder to draw combustion air into the working cylinder. The braking intake cam curve of the braking cam 12 is provided, in principle, to open the intake valves 14, 15 twice during one revolution of the intake camshaft 10 so as to draw the combustion air into the working cylinder twice. The intake elevations 26, 27 of the braking cam 12 and the intake elevation 38 of the firing cam 11 can be seen well in particular in FIGS. 4 to 6.

For actuating the intake valves 14, 15, the valve train device comprising the integrated engine brake device includes a first intake cam follower 13, which is provided for the firing mode of the intake valves 14, 15, and a second braking intake cam follower 16, which is provided for the braking mode of the intake valves 14, 15. The intake cam follower 13 provided for the firing mode is only provided for an operative connection to the firing cam 11. The braking intake cam follower 16 provided for the braking mode is only provided for the operative connection to the braking cam 12.

For switching between the firing mode of the intake valves 14, 15 and the braking mode of the intake valves 14, 15, the engine brake device comprises a switchover device 17 that is assigned to the intake camshaft 10 and provided for the purpose of switching between an actuation of the two intake valves 14, 15 by the firing cam 11 and an actuation of the two intake valves 14, 15 by the braking cam 12. The switchover device 17 assigned to the intake camshaft 10 is provided for the purpose of switching back and forth between the intake cam curve of the firing cam 11 being picked up by the assigned intake cam follower 13 and the braking intake cam curve of the braking cam 12 being picked up by the assigned braking intake cam follower 16. The switchover device 17 assigned to the intake camshaft 10 is only provided for switching the actuation of the intake valves 14, 15 of the one working cylinder. The engine brake device can generally comprise further, analogously designed, switchover devices assigned to the intake camshaft 10 for the further working cylinders, it being possible for at least some of these switchover devices to be coupled to one another.

The engine brake device comprises two rocker arms assigned to the intake cam group comprising a first rocker arm 21 and a second braking rocker arm 22. The rocker arm 21 is provided for the firing mode of the intake valves 14, 15 and comprises the intake cam follower 13, which is provided for the operative connection to the firing cam 11 of the intake cam group. The braking rocker arm 22 is provided for the braking mode of the intake valves 14, 15 and comprises the braking intake cam follower 16, which is provided for the operative connection to the braking cam 12 of the intake cam group. The rocker arm 21 provided for the firing mode of the intake valves 14, 15 acts on both intake valves 14, 15. The braking rocker arm 22 provided for the braking mode of the intake valves 14, 15 acts on both intake valves 14, 15 in the shown exemplary embodiment, but in principle can also act on only one of the intake valves 14, 15. The rocker arm 21 and the braking rocker arm 22 are each designed as roller rockers.

In the exemplary embodiment shown according to FIGS. 1 to 8, the braking rocker arm 22, which comprises the braking intake cam follower 16 assigned to the braking cam 12, is provided for the purpose of actuating the rocker arm 21 that comprises the intake cam follower 13 assigned to the firing cam 11. For this purpose, the braking rocker arm 22, which comprises the braking intake cam follower 16 assigned to the braking cam 12, is coupled directly to the rocker arm 21 that comprises the intake cam follower 13 assigned to the firing cam 11 in the braking mode of the intake valves 14, 15. The braking rocker arm 22 is seated directly against the rocker arm 21 in the braking mode. In the firing mode of the intake valves 14, 15, the intake cam follower 13 is operatively connected to the firing cam 11, and the braking intake cam follower 16 is operatively decoupled from the braking cam 12 and the rocker arm 21. In the braking mode of the intake valves 14, 15, the intake cam follower 13 is operatively decoupled from the firing cam 11, and the braking intake cam follower 16 is operatively connected to the braking cam 12 and the rocker arm 21. The rocker arm 21 that comprises the intake cam follower 13 assigned to the firing cam 11 is operatively connected to the intake valves 14, 15 in the firing mode and in the braking mode. The braking rocker arm 22, which comprises the braking intake cam follower 16 assigned to the braking cam 12, is operatively decoupled from the intake valves 14, 15 in the firing mode, and is operatively connected to the intake valves 14, 15 by way of the rocker arm 21 in the braking mode. The movements of the rocker arm 21 and the braking rocker arm 22 are separated from one another in the firing mode, and the movements are connected to one another in the braking mode.

The switchover device 17 assigned to the intake camshaft 10 is provided for the purpose of translating a torque of the intake camshaft 10 into a force for switching between the firing mode and the braking mode. For activation by way of an open-loop and closed-loop control unit of the valve train device, which is not shown in greater detail, the switchover device 17 assigned to the intake camshaft 10 comprises an electromagnetic actuator 39, which can be used to trigger the switch between the firing mode and the braking mode. With the exception of the actuator 39, which is only provided to trigger the switch between the firing mode and the braking mode, the switchover device 17 assigned to the intake camshaft 10 has an entirely mechanical design.

The switchover device 17 assigned to the intake camshaft 10 comprises a gate element 18 that is non-rotatably but axially displaceably connected to the intake camshaft 10. The gate element 18 comprises a first slotted guide track 19, which is provided for switching from the firing mode into the braking mode of the intake valves 14, 15, and a second slotted guide track 20, which is provided for switching from the braking mode into the firing mode of the intake valves 14, 15. The slotted guide tracks 19, 20 are offset with respect to one another on the gate element 18 by an appropriate angle. Each of the slotted guide tracks 19, 20 has an angular extension corresponding to the function thereof. The slotted guide tracks 19, 20 each comprise an engagement segment, a shifting segment and a disengagement segment, which are not identified in the figures. The engagement segments directed in the circumferential direction each have an increasing slotted guide track depth. The shifting segments, which have a substantially constant slotted guide track depth, have an axial component. The disengagement segments each have a decreasing slotted guide track depth.

In particular the shifting segments of the slotted guide tracks 19, 20 are provided for the purpose of translating a rotational movement of the intake camshaft 10 into an axial shifting movement of the gate element 18, relative to a rotational axis 40 of the intake camshaft 10. The shifting movements, which can be triggered by way of the slotted guide tracks 19, 20, are oriented in opposite directions, which is to say the one slotted guide track 19 is provided for the purpose of shifting the gate element 18 in the first direction, while the second slotted guide track 20 is provided for the purpose of shifting the gate element 18 into the opposite second direction. The gate element 18 has two discrete shift positions between which it can be shifted by way of the slotted guide tracks 19, 20. In the shown exemplary embodiment, a shifting movement triggered by the slotted guide track 19 results in a switch from the firing mode into the braking mode, and accordingly a shifting movement of the slotted guide track 20 results in a switch from the braking mode into the firing mode.

The actuator 39, which is provided to trigger the switch between the firing mode and the braking mode of the intake valves 14, 15, is disposed in a stationary manner with respect to the gate element 18, which is disposed so as to be rotatable by the intake camshaft 10. The valve train device comprises a housing 41, to which the actuator 39 is rigidly connected. The actuator 39, which is provided to trigger the switch between the firing mode and the braking mode of the intake valves 14, 15, comprises a shifting pin 42, which when extended engages in the respective slotted guide track 19, 20 of the gate element 18 in a forcibly guided manner. The shifting pin 42 is extended for triggering the switchover. Thereafter, the shifting pin 42 is caused to engage in the associated slotted guide track 19, 20 by way of the appropriate engagement segment. During a further rotational movement of the intake camshaft 10, the gate element 18 is displaced by the shifting element, wherein axial forces for the switchover process are generated from the torque acting on the intake camshaft 10 and supported via the shifting pin 42. Thereafter, the shifting pin 42 is pushed back in by the disengagement segment. A switchover in the two directions takes place analogously. The shifting pin 42 is provided for the purpose of engaging in the other slotted guide track 20, 19 in a forcibly guided manner during a subsequent switchover after disengaging from the one slotted guide track 19, 20.

So as to switch the operative connection between the intake camshaft 10 and the intake cam follower 13 and the braking intake cam follower 16, the switchover device 17 assigned to the intake camshaft 10 comprises a rocker arm mounting 25, which has a first end position assigned to the firing mode and a second braking end position assigned to the braking mode. The rocker arm mounting 25 is used in particular to mount the rocker arm 21 and the braking rocker arm 22 and establishes a rocker arm axis 23 for the rocker arm 21 and a braking rocker arm axis 24 for the braking rocker arm 22, about which the respective corresponding rocker arms 21, 22 are pivotably mounted (see FIGS. 5 and 6).

The rocker arm mounting 25 comprises a mounting element 43 on which the rocker arm 21 and the braking rocker arm 22 are each mounted. The mounting element 43 itself is pivotably mounted. A bearing axis 44 about which the mounting element 43 can pivot is parallel offset from the rocker arm axis 23 and the braking rocker arm axis 24. The mounting element 43 is mounted opposite the housing 41 of the valve train device.

The mounting element 43 is designed in the form of a U-shaped bracket, wherein ends 45, 46 of the mounting element 43, which are oriented parallel to the rotational axis 40 of the intake camshaft 10, used for mounting about the bearing axis 44, and wherein the rocker arms 21, 22 are joined to a portion of the mounting element 43 that runs substantially parallel to the intake camshaft 10. The ends 45, 46 of the mounting element 43 are rotatably accommodated in bearings 47, 48 of the housing 41.

Figure 2:
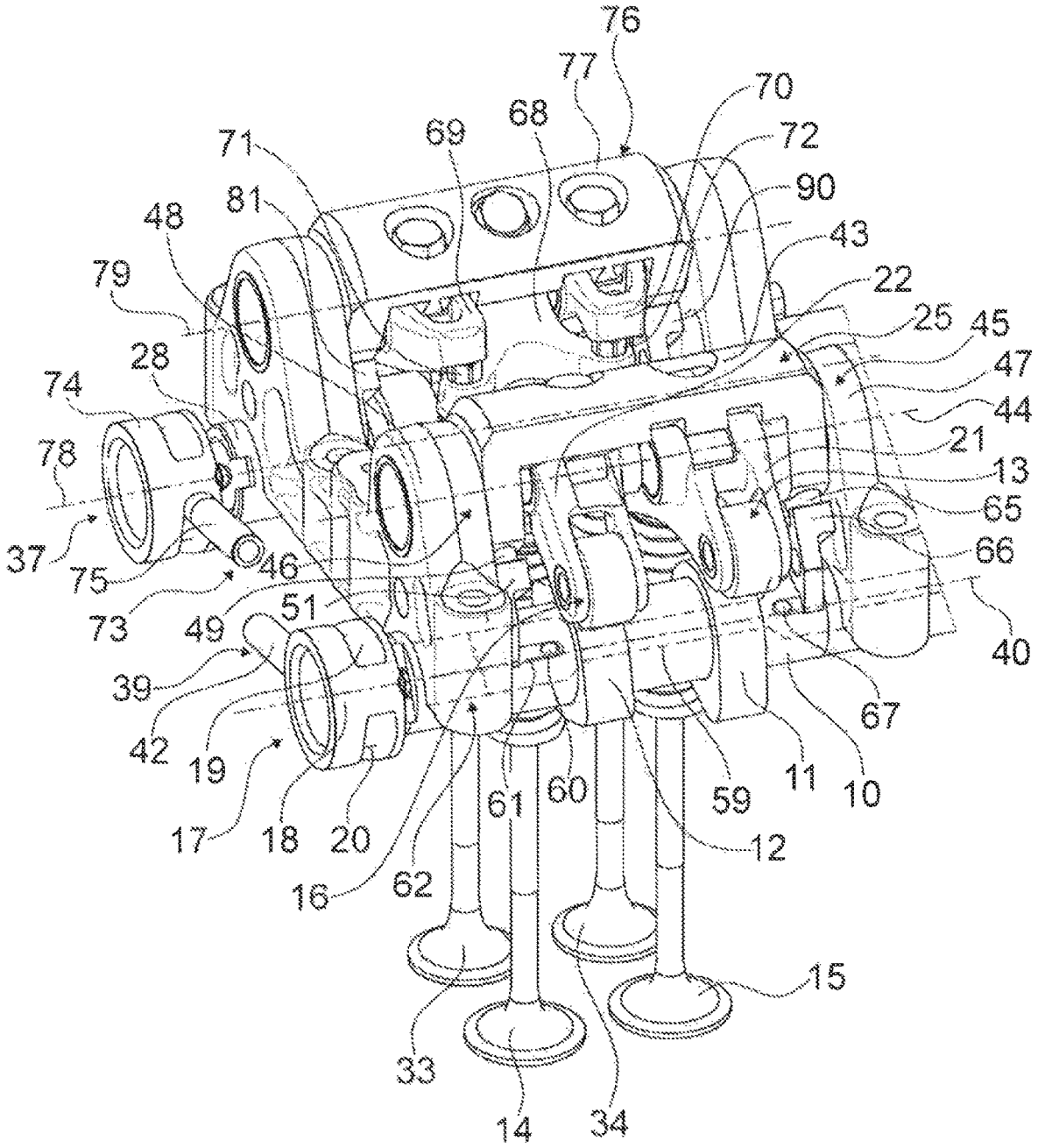
FIG. 2 shows a perspective view of the valve train device.
Figure 3:
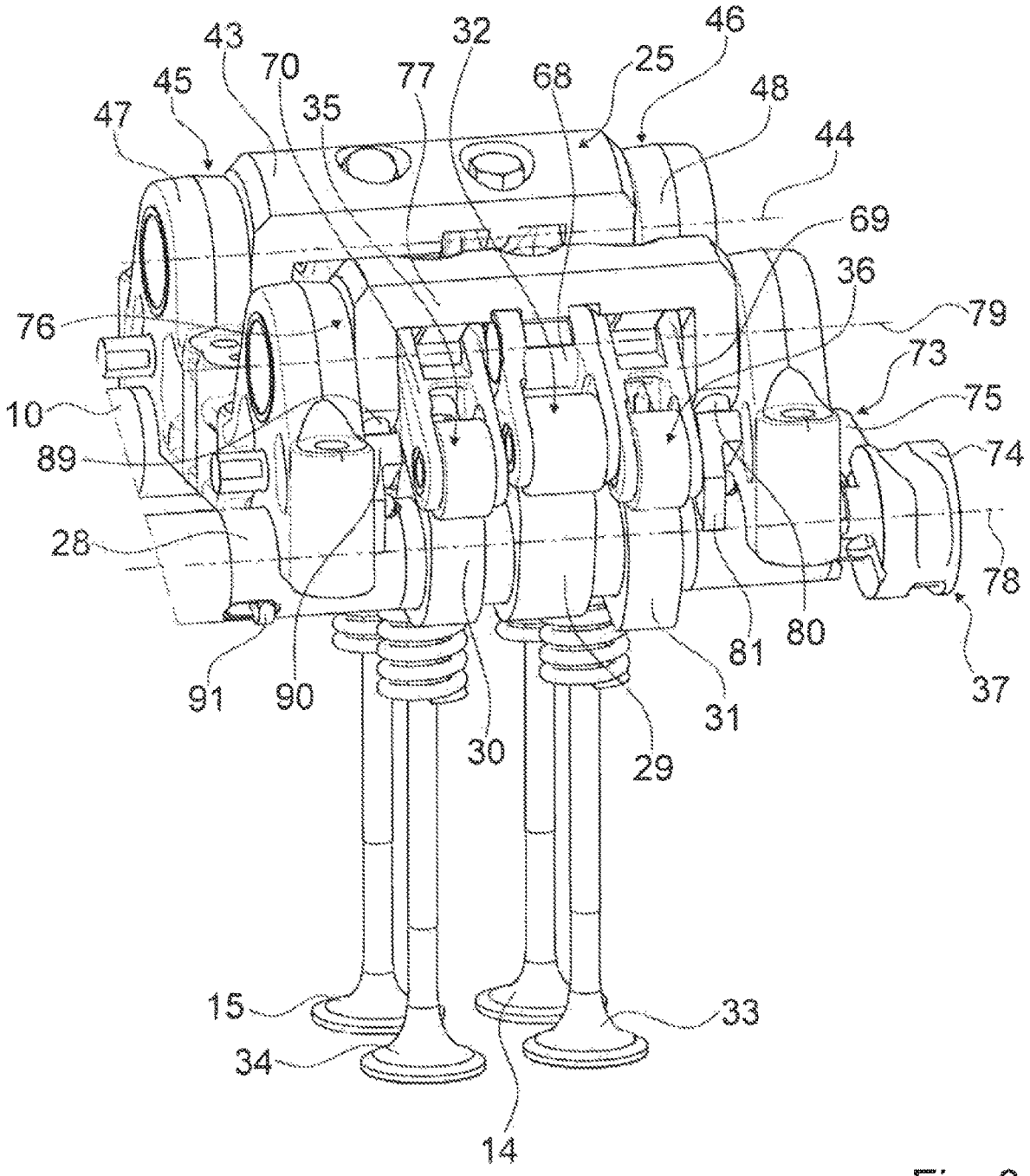
FIG. 3 shows another perspective of the valve train device.
Figure 4:
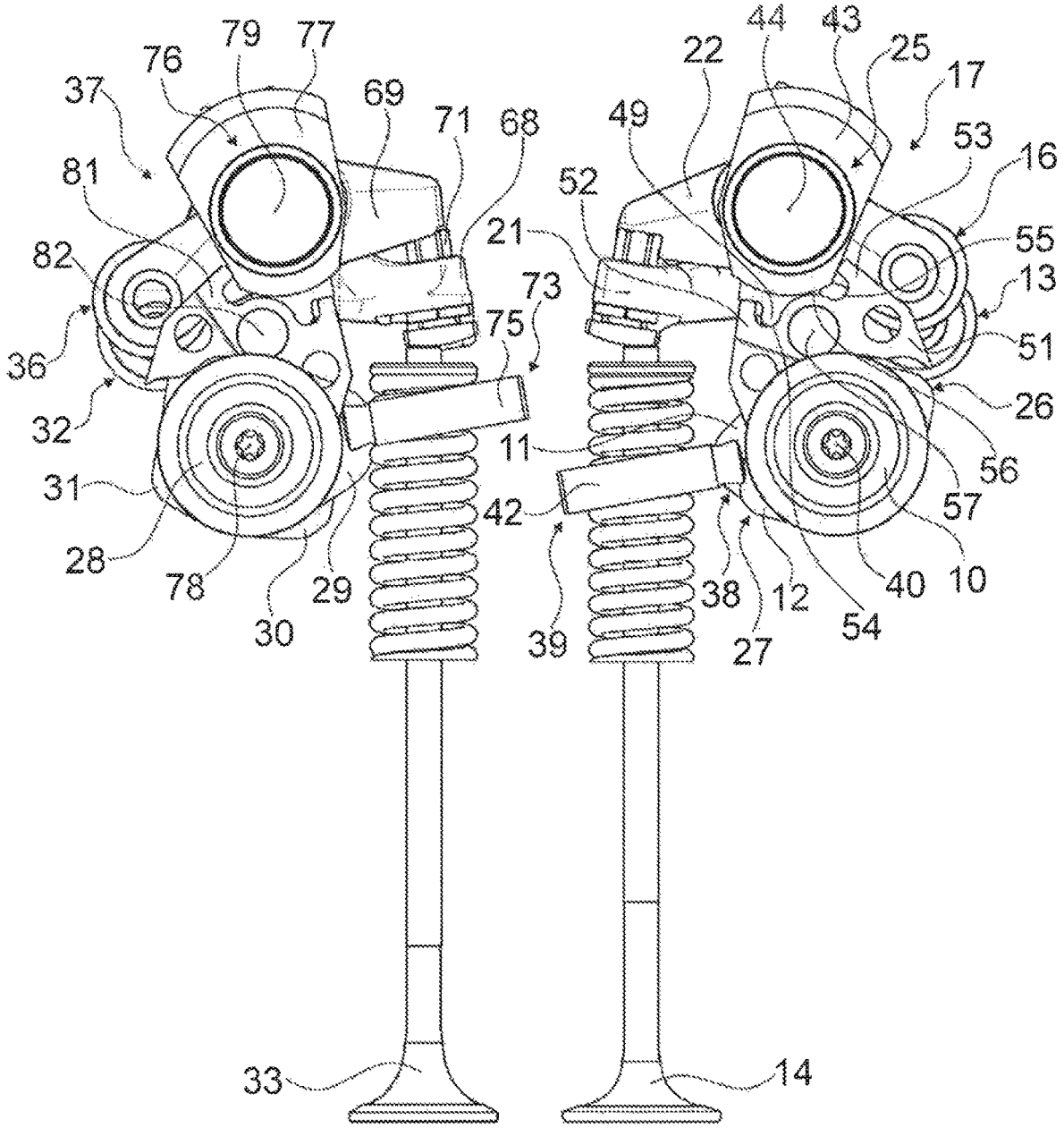
FIG. 4 shows a front view of the valve train device.
Figure 5:
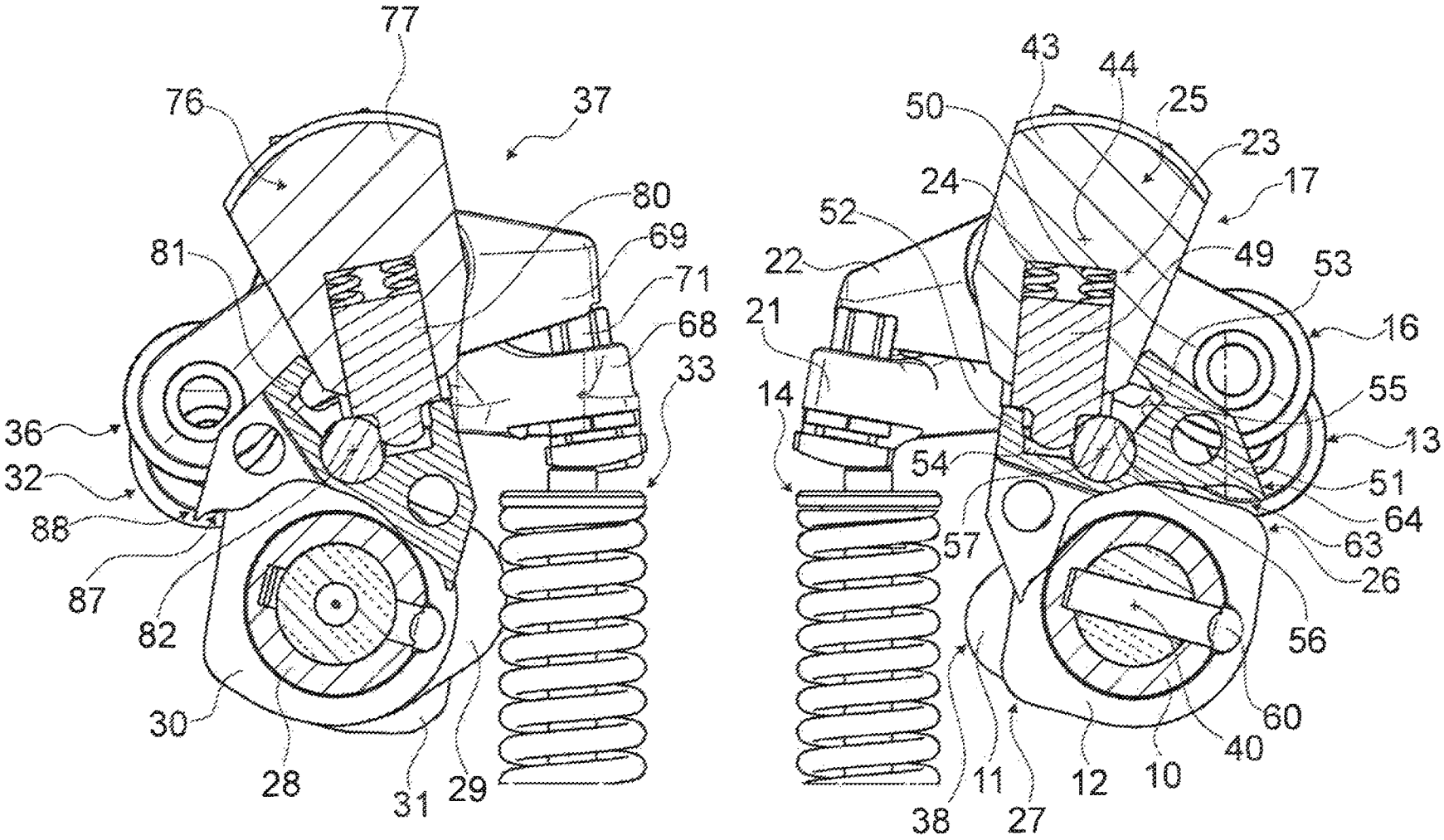
FIG. 5 shows a cross-section through the valve train device with the firing mode activated along an intersecting line AA from FIG. 7.
Figure 6:
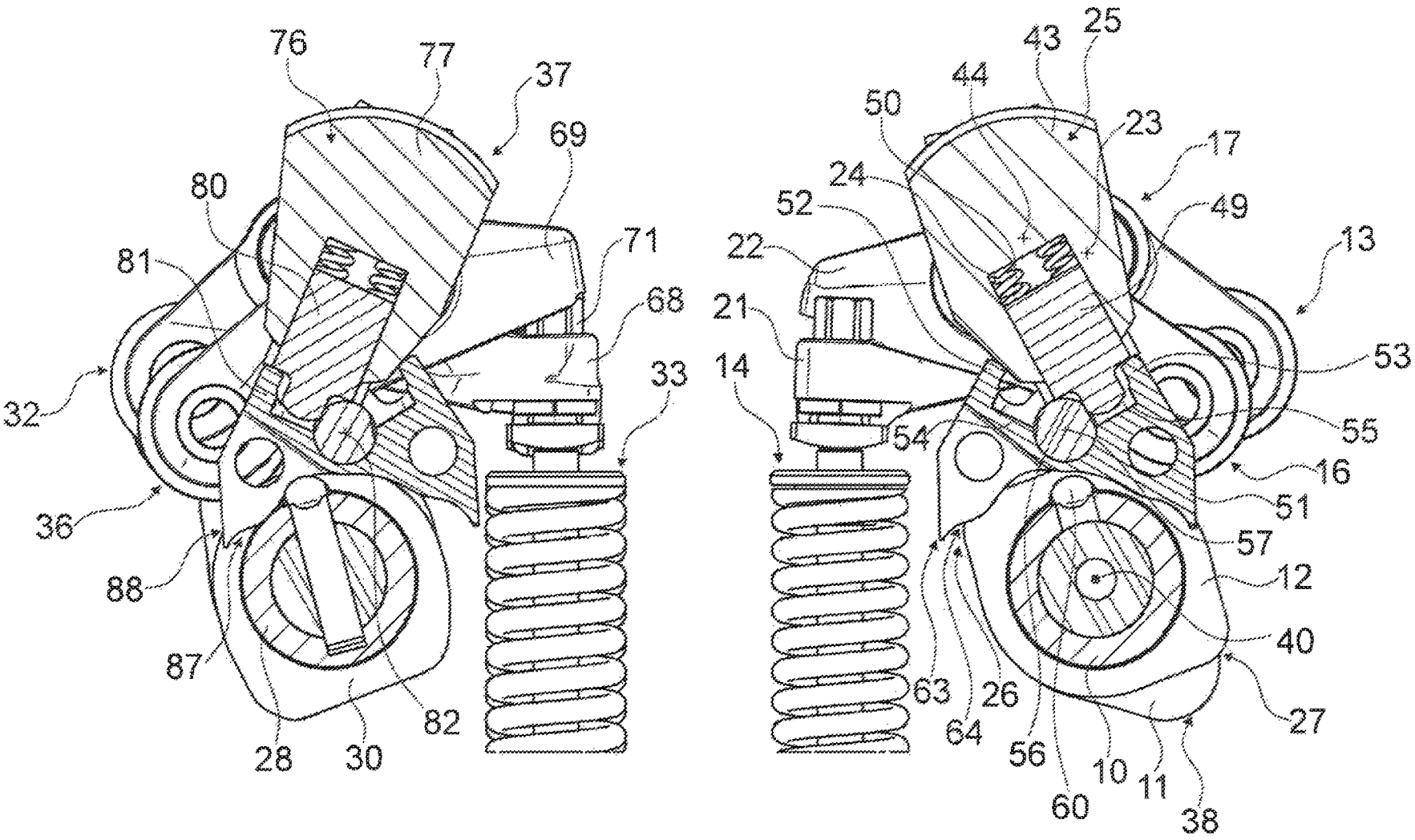
FIG. 6 shows the cross-section with the braking mode activated along the intersecting line AA from FIG. 7.
Figure 7:
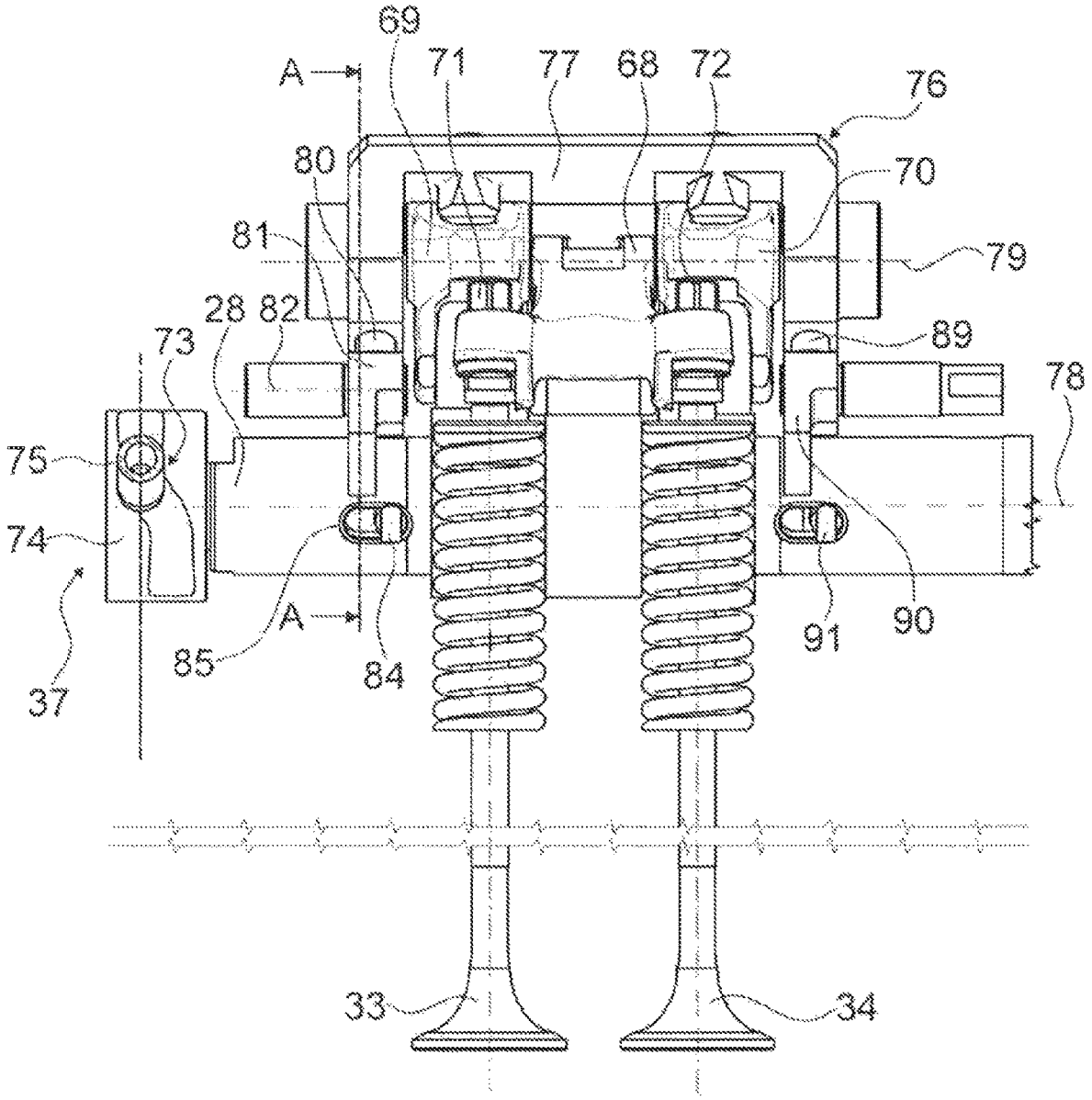
FIG. 7 shows a side view of the valve train device.

The bearing axis 44 of the mounting element 43 is oriented parallel offset from the rotational axis 40 of the intake camshaft 10 (see FIGS. 2 to 6). In the first end position, the intake cam follower 13 provided for the firing mode of the intake valves 14, 15 is in constant contact with the firing cam 11 (FIGS. 4 and 5). In contrast, the braking intake cam follower 16 provided for the braking mode of the intake valves 14, 15 is lifted off the braking cam 12, whereby the braking cam 12 passes beneath the braking intake cam follower 16 without action (FIGS. 4 and 5). Conversely, in the second end position, the braking intake cam follower 16 provided for the braking mode of the intake valves 14, 15 is in constant contact with the braking cam 12, while the intake cam follower 13 provided for the firing mode of the intake valves 14, 15 is lifted off the firing cam 11, whereby the firing cam 11 passes beneath the intake cam follower 13 without action (FIGS. 2 and 6).

The rocker arm mounting 25 is provided so as to be switched by way of the rotational movement of the intake camshaft 10. When the mounting element 43 is switched to the first end position, generally a force that is directed in the direction of the second end position acts on the mounting element 43 when the intake valves 14, 15 are actuated by the firing cam 11 (FIG. 5). When the mounting element 43 is switched to the second end position, generally a force that is directed in the direction of the first end position acts on the mounting element 43 when the intake valves 14, 15 are actuated by the braking cam 12 (FIG. 6).

The force acting on the mounting element 43 which is utilized for the switch between the two end positions results from an actuating force that is exerted on the intake valves 14, 15 by way of the intake camshaft 10 in the firing mode and in the braking mode. The mounting element 43 braces this actuating force. Since the rocker arm axis 23 and the braking rocker arm axis 24, about which the rocker arm 21 and the braking rocker arm 22 are each pivotably mounted with respect to the mounting element 43, are offset from one another, a different force acts on the mounting element 43, depending on which rocker arm 21, 22 is used to actuate the intake valves 14, 15. The bearing axis 44 of the mounting element 43 is operatively disposed between the rocker arm axis 23 and the braking rocker arm axis 24. When the rocker arm 21 is actuated, a torque acting on the mounting element 43 results from the actuating force of the rocker arm 21, this force being oriented in the opposite direction, with respect to the bearing axis 44 of the mounting element 43, as compared to the torque resulting from the actuating force on the braking rocker arm 22, which acts on the mounting element 43 when the braking rocker arm 22 is actuated. Since the actuating force results in each case from the torque of the intake camshaft 10, and the torque on the mounting element 43 in turn results from the actuating force, the rocker arm mounting 25 is switched by way of the rotational movement of the intake camshaft 10.

So as to fix the rocker arm mounting 25, the switchover device 17 assigned to the intake camshaft 10 comprises a spring-loaded detent engagement element 49, which is provided to fix the rocker arm mounting 25 in the two end positions. The detent engagement element 49 is mounted so as to be axially movable with respect to the mounting element 43. The switchover device 17 assigned to the intake camshaft 10 comprises a spring element 50, which is disposed between the mounting element 43 and the detent engagement element 49.

For the operative connection to the detent engagement element 49, the switchover device 17 assigned to the intake camshaft 10 comprises a detent contour element 51, against which the detent engagement element 49 is supported. For the form-locked connection to the detent engagement element 49, the detent contour element 51 has a detent contour having a first depression 54 and a second braking depression 55 between a first stop 52 and a braking stop 53. An elevation 56 is located between the depression 54 and the braking depression 55. The first depression 54, which is assigned to the first end position in the firing mode, is located between the first stop 52 and the elevation 56. The second braking depression 55, which is assigned to the second braking end position in the braking mode, is located between the braking stop 53 and the elevation 56. The depression 54 and the braking depression 55 define two locking positions, in which the detent engagement element 49 and the detent contour element 51 are connected to one another in a form-locked manner.

A pivoting movement of the mounting element 43 is limited by the two mechanical stops 52, 53, which define the two end positions of the rocker arm mounting 25. During a pivoting movement of the mounting element 43 out of the second end position in the braking mode into the first end position in the firing mode, the stops 52, 53 limit the pivoting movement of the mounting element 43 by the braking stop 53 being seated against the mounting element 43, and the stop 52 being seated against the detent engagement element 49. Accordingly, the stops 52, 53 limit the pivoting movement of the mounting element 43 out of the first end position in the firing mode into the second end position in the braking mode by now the stop 52 being seated against the mounting element 43, and the braking stop 53 being seated against the detent engagement element 49. The movement of the detent engagement element 49 is connected to that of the mounting element 43. During a movement of the mounting element 43 from the one end position into the other end position, the detent engagement element 49 is moved from the one depression 54, 55 over the elevation 56 into the other depression 55, 54. In the end positions, the detent engagement element 49 and the detent contour element 51 fix the mounting element 43 against the torque acting during the actuation of the intake valves 14, 15. A spring force, which is provided by the spring element 50 supported between the detent engagement element 49 and the mounting element 43, is sufficiently large to brace the torque resulting from the actuating force of the intake valves 14, 15 against the elevation 56, so that the detent engagement element 49 does not move from one depression 54, 55 into the respective other depression 55, 54.

So as to release the detent engagement element 49 from one of the locking positions thereof, the detent contour element 51 is movably mounted. The detent contour element 51 has a bearing axis 57, which is located in the region of the elevation 56 of the detent contour. In the shown exemplary embodiment, the bearing axis 57 for the detent contour element 51 forms the elevation 56 between the two depressions 54, 55, which is to say the detent contour is partially formed by the bearing axis 57. When the mounting element 43 is moved from the one end position into the other end position, a virtual center line of the detent engagement element 49 pivots across the bearing axis 57 of the detent contour element 51. The bearing axis 57 is thus located between the two depressions 54, 55 that form the end positions of the rocker arm mounting 25.

The movably mounted detent contour element 51 can be pivoted between the first locking position, which is assigned to the firing mode (FIGS. 4 and 5), and the second braking locking position, which is assigned to the braking mode (FIG. 6). In the first locking position of the detent contour element 51, the mounting element 43 is in the firing mode in the first end position thereof, wherein the detent engagement element 49 engages in the first depression 54 of the detent contour. In the second braking locking position of the detent contour element 51, the mounting element 43 is in the braking mode in the second end position thereof, wherein the detent engagement element 49 engages in the second braking depression 55 of the detent contour. In the locking positions, one of the depressions 54, 55 of the detent contour element 51 in each case forms a global minimum for the detent engagement element 49, the detent engagement element 49 being guided in this minimum when the actuating force for the intake valves 14, 15 is supported by way of the mounting element 43 against the intake camshaft 10.

Depending on the locking positions into which the detent contour element 51 is shifted, the mounting element 43 for the rocker arms 21, 22 is shifted in the end position corresponding to the locking position with the next actuation of the intake valves 14, 15. The switch between the firing mode and the braking mode takes place in that the detent contour element 51 is pivoted from the one locking position into the other locking position.

The gate element 18 is provided for the purpose of pivoting the detent contour element 51 from the locking positions into an intermediate position between the locking positions. The gate element 18 and the detent contour element 51 are mechanically coupled to one another. The gate element 18 axially protruding from the intake camshaft 10 is connected to a shift rod 59 that is axially displaceably accommodated in the intake camshaft 10. The shift rod 59 accommodated in the intake camshaft 10 is shown with a dotted line in FIG. 2. When the shifting pin 42 engages in one of the slotted guide tracks 19, 20, the gate element 18 and the shift rod 59 are axially displaced along the rotational axis 40 of the intake camshaft 10. An actuating pin 60 is accommodated in the shift rod 59, the actuating pin radially protruding from the intake camshaft 10 through a longitudinal slot 61. The actuating pin 60 is thus likewise displaced along the rotational axis 40 of the intake camshaft 10 during the axial displacement of the shift rod 59 in the longitudinal slot 61 thereof. The actuating pin 60 is provided for the purpose of transmitting the torque that is present on the intake camshaft 10 to the detent contour element 51 and to pivot the detent contour element 51 by way of the torque. The gate element 18 connected to the shift rod 59 comprises a suitable detent device 62 with the intake camshaft 10, so that a corresponding position of the shift rod 59 can be maintained in the intake camshaft 10 for the braking mode or firing mode.

The detent contour element 51 is disposed spatially between the detent engagement element 49 and the intake camshaft 10. This element has a side facing the detent engagement element 49 which forms the detent contour. Moreover, this element has a side facing the intake camshaft 10 which forms an actuating contour for pivoting by way of the torque of the intake camshaft 10. The actuating contour has two tracks 63, 64, which are offset from one another along the rotational axis 40 of the intake camshaft 10. Depending on which shift position the gate element 18 is shifted to, the actuating pin 60 engages in the one track 63 of the actuating contour or in the other track 64 of the actuating contour. The length of a path by which the gate element 18 can be axially displaced corresponds to a distance between the tracks 63, 64 present in the actuating contour of the detent contour element 51.

In relation to the rotational movement of the actuating pin 60 about the rotational axis 40 of the intake camshaft 10, the tracks 63, 64 are designed as inclined tracks. The actuating contour of the detent contour element 51 is provided for the purpose of translating the torque of the intake camshaft 10 acting on the actuating pin 60 into a torque acting on the detent contour element 51 so as to pivot the detent contour element 51 about the bearing axis 57 thereof. The actuating pin 60, in operative connection with the actuating contour of the detent contour element 51, is provided for the purpose of shifting the detent contour element 51 from the first locking position of the firing mode into the intermediate position in the first shift position of the gate element 18. For this purpose, the shifting pin 42 engages in the slotted guide track 19, and the actuating pin 60 is moved from the track 63 to the track 64. In the second shift position of the gate element 18, the detent contour element 51 shifts from the second locking position of the braking mode into the intermediate position. For this purpose, the shifting pin 42 engages in the slotted guide track 20, and the actuating pin 60 is moved from the track 64 to the track 63. In each case, the actuating pin 60 is thus only provided for the purpose of shifting the detent contour element 51 into the intermediate position.

The intermediate position is designed as a center position between the two locking positions in the shown exemplary embodiment. When the detent contour element 51 is pivoted into the center position, the detent engagement element 49 moves in the detent contour. The detent engagement element 49 moves inside the detent contour of the corresponding depression 54, 55 onto the elevation 56. Since the detent contour element 51 is also pivoted, the intermediate position forms an unstable position. The detent engagement element 49 is then guided out of the intermediate position and into the other locking position when the actuating force on the intake valves 14, 15, which results from the rotation and the torque of the intake camshaft 10, is supported against the intake camshaft 10 by way of the mounting element 43 during the next actuation of the intake valves 14, 15.

The switchover process between the firing mode and the braking mode of the intake valves 14, 15 is thus carried out in two steps. In the first step, the torque and the rotational movement of the intake camshaft 10 are transmitted via the gate element 18, the detent contour element 51 and the detent engagement element 49 to the mounting element 43, and cause the detent engagement element 49 to move from the corresponding locking position into the intermediate position. In the second step, the torque and the rotational movement of the intake camshaft 10 are transmitted via the corresponding rocker arms 21, 22, and cause the detent engagement element 49 to move from the intermediate position into the corresponding locking position.

In the shown exemplary embodiment, the switchover device 17 assigned to the intake camshaft 10 comprises a second detent engagement element 65 and a detent contour element 66, which are likewise switched by way of the gate element 18. For this purpose, the gate element 18 comprises a second actuating pin 67 and a spring element, which is not shown in greater detail, which are provided for an operative connection with the second detent contour element 66. The two detent contour elements 51, 66 act in parallel.

The exhaust cam group comprises a firing cam 29, which is provided for the purpose of opening the exhaust valves 33, 34 in the firing mode, a first braking cam 30, which is provided for the purpose of opening one of the exhaust valves 34 in the braking mode, and a second braking cam 31, which is provided for the purpose of opening the other exhaust valve 33 in the braking mode. Both the firing cam 29 and the first braking cam 30, and the firing cam 29 and the second braking cam 31, have different exhaust cam curves. The exhaust cam curve of the firing cam 29 has an exhaust elevation, which is provided in particular for the purpose of opening the exhaust valves 33, 34 while the piston is being moved from bottom dead center to top dead center in the appropriate working cylinder to expel exhaust gas from the working cylinder after combustion. In principle, the exhaust cam curves of the braking cams 30, 31 are each provided for the purpose of opening the exhaust valves 33, 34 assigned to them after the piston has been moved from bottom dead center to top dead center in the corresponding working cylinder so as to expel compressed air or combustion air from the working cylinder, thus leaving this air unused.

The two braking cams 30, 31 of the exhaust cam group have exhaust cam curves that differ from one another, so that the exhaust valves 33, 34 have activating times or opening times that differ from one another in the braking mode. The exhaust cam curves are designed in such a way that the exhaust valves 33, 34 are opened alternately so as to allow the compressed air or combustion air to escape unused from the working cylinder. By virtue of such a differing design of the exhaust cam curves of the braking cams 30, 31, the exhaust valves 33, 34 are each actuated, and thus opened, only once during a rotation of the exhaust camshaft 28, wherein the working cylinder is opened twice in total during the rotation of the exhaust camshaft 28. As a result, a load of the exhaust valves 33, 34 in the braking mode is reduced, thereby increasing the service life of the exhaust valves 33, 34. In principle, the differing design of the exhaust cam curves of the braking cams 30, 31 can be achieved in a wide variety of ways that appear useful to a person skilled in the art, for example in such a manner that one of the exhaust valves 33 is actuated every time in the braking mode so as to allow the compressed air to escape unused, and the other exhaust valve 34 is actuated only every second time, so that one of the exhaust valves 33 is actuated twice, in particular during one rotation of the exhaust camshaft 28, and the other exhaust valve 34 is actuated only once. Furthermore, it is also conceivable, in principle, that the exhaust cam curves of the braking cams 30, 31 have identical exhaust cam curves, whereby a large opening cross-section, and thus a rapid escape of the compressed air from the working cylinder, can be achieved in the braking mode.

The engine brake device is designed as a 2-stroke engine brake as a result of the setting of the braking mode of the intake camshaft 10 and the braking mode of the exhaust camshaft 28. Due to the braking mode of the intake valves 14, 15, combustion air is drawn twice into the working cylinder during a rotation of the intake and exhaust camshafts 10, 28, and due to the braking mode of the exhaust valves 33, 34, the compression of the drawn-in combustion air is left unused twice. The engine brake device can, of course, also be designed as a 4-cycle engine brake. In this case, in particular only the braking mode of the exhaust valves 33, 34 is set, and setting the braking mode of the intake valves 14, 15 is dispensed with. The exhaust cam curves of the braking cams 30, 31 are then in particular identical. In principle, one of the braking cams 30, 31 of the exhaust cam group can be dispensed with.

For actuating the exhaust valves 33, 34, the valve train device comprising the integrated engine brake device includes an exhaust cam follower 32, which is provided for the firing mode of the exhaust valves 33, 34, and two braking exhaust cam followers 35, 36, which are provided for the braking mode of the exhaust valves 33, 34. The exhaust cam follower 32, which is provided for the firing mode of the exhaust valves 33, 34, is only provided for an operative connection to the firing cam 11. The braking exhaust cam follower 35, which is provided for the braking mode of the exhaust valves 33, 34, is only provided for the operative connection to the first braking cam 30. The braking exhaust cam follower 36, which is provided for the braking mode of the exhaust valves 33, 34, is only provided for the operative connection to the second braking cam 31. The braking exhaust cam followers 35, 36, which are provided for the braking mode of the exhaust valves 33, 34, are each only provided for actuating one of the exhaust valves 33, 34.

For switching between the firing mode and the braking mode of the exhaust valves 33, 34, the engine brake device comprises a switchover device 37 that is assigned to the exhaust camshaft 28 and provided for the purpose of switching between an actuation of the two exhaust valves 33, 34 by the firing cam 29 and an actuation of the two exhaust valves 33, 34 by the braking cams 30, 31. The switchover device 37 assigned to the exhaust camshaft 28 is provided for the purpose of switching back and forth between the exhaust cam curve of the firing cam 29 being picked up by the assigned exhaust cam follower 32 and the exhaust cam curves of the braking cams 30, 31 being picked up by the respective assigned braking exhaust cam followers 35, 36. The switchover device 37 assigned to the exhaust camshaft 28 is only provided for switching the actuation of the exhaust valves 33, 34 of the one working cylinder. The engine brake device can generally comprise further, analogously designed, switchover devices assigned to the exhaust camshaft 28 for the further working cylinders, it being possible for at least some of these switchover devices to be coupled to one another.

The valve train device comprises three rocker arms 68, 69, 70 assigned to the exhaust cam group. The one rocker arm 68 is provided for the firing mode of the exhaust valves 33, 34 and comprises the exhaust cam follower 32, which is provided for the operative connection to the firing cam 29 of the exhaust cam group. The two other braking rocker arms 69, 70 are provided for the braking mode of the exhaust valves 33, 34. The braking rocker arm 69 comprises the braking exhaust cam follower 36, which is provided for the operative connection to the braking cam 31 of the exhaust cam group. The braking rocker arm 70 comprises the braking exhaust cam follower 35, which is provided for the operative connection to the braking cam 30 of the exhaust cam group. The rocker arm 68 provided for the firing mode acts on both exhaust valves 33, 34. In the shown exemplary embodiment, the braking rocker arms 69, 70 provided for the braking mode each act on only one of the two exhaust valves 33, 34. In the braking mode, the braking rocker arm 69 acts on the exhaust valve 33, and the braking rocker arm 70 acts on the exhaust valve 34. In the braking mode, the braking rocker arm 69 acts on the exhaust valve 33 by way of a setting element 71 that is longitudinally displaceably mounted in the rocker arm 68. In the braking mode, the braking rocker arm 70 acts on the exhaust valve 34 by way of a setting element 72 that is longitudinally displaceably mounted in the rocker arm 68. The movements of the three rocker arms 68, 69, 70 are separated from one another. In the firing mode of the exhaust valves 33, 34, the exhaust camshaft 28 actuates the rocker arm 68, while the braking rocker arms 69, 70 are decoupled from the exhaust camshaft 28. In the braking mode of the exhaust valves 33, 34, the exhaust camshaft 28 actuates the braking rocker arms 69, 70, while the other rocker arm 68 is decoupled from the exhaust camshaft 28. In principle, the valve train device can comprise only one of the braking rocker rams 69, 70 for the braking mode, which in the braking mode acts only on one of the exhaust valves 33, 34, or which, in particular analogously to the intake side, acts on both exhaust valves 33, 34.

The switchover device 37 assigned to the exhaust camshaft 28 is provided for the purpose of translating a torque of the exhaust camshaft 28 into a force for switching between the firing mode and the braking mode of the exhaust valves 33, 34. For activation by way of the open-loop and closed-loop control unit, which is not shown in greater detail, the switchover device 37 assigned to the exhaust camshaft 28 comprises an electromagnetic actuator 73, which can be used to trigger the switch between the firing mode and the braking mode. With the exception of the actuator 73, which is only provided to trigger the switch between the firing mode and the braking mode, the switchover device 37 assigned to the exhaust camshaft 28 has an entirely mechanical design.

The switchover device 37 assigned to the exhaust camshaft 28 and the switchover device 17 assigned to the intake camshaft 10 can be activated independently and separately from one another. The open-loop and closed-loop control unit, which is not shown in greater detail, is provided for the purpose of triggering the switching between the firing mode and the braking mode of the exhaust valves 33, 34, and the switch between the firing mode and the braking mode of the intake valve 14, 15, separately from one another. For triggering the switchover, the open-loop and closed-loop control unit not shown in greater detail activates the corresponding actuator 39, 73.

The switchover device 37 assigned to the exhaust camshaft 28 and the switchover device 17 assigned to the intake camshaft 10 are designed analogously to one another. Furthermore, mechanics and/or components, in particular those provided for switching between the firing mode and the braking mode, for the intake valves 14, 15 and for the exhaust valves 33, 34 are analogous. For this reason, the switchover device 37 assigned to the exhaust camshaft 28, the switching process, and the components or elements provided for this purpose are described only briefly. As a result of the analogous design, features and the operating principle provided in the description and/or in the figures for the intake side can be applied to the exhaust side, or those for the exhaust side can be applied to the intake side.

The switchover device 37 assigned to the exhaust camshaft 28 comprises a gate element 74 that is non-rotatably but axially displaceably connected to the exhaust camshaft 28 and includes two slotted guide tracks, which are provided for the switchover from the firing mode to the braking mode. The gate elements 18, 74 are designed analogously to one another, for which reason reference is made to the description of the gate element 18 for the description of the gate element 74.

The actuator 73 comprises a shifting pin 75, which when extended engages in the respective slotted guide track of the gate element 74. The actuators 39, 73 are designed analogously to one another, for which reason reference is made to the description of the actuator 39 for the description of the actuator 73.

So as to switch the operative connection between the exhaust camshaft 28 and the exhaust cam followers 32, 35, 36, the switchover device 37 assigned to the exhaust camshaft 28 comprises a rocker arm mounting 76, which has a first end position assigned to the firing mode and a second end position assigned to the braking mode. The rocker arm mounting 76 is used in particular to mount the rocker arms 68, 69, 70 and establishes a respective rocker arm axis for the rocker arms 68, 69, 70 about which the corresponding rocker arm 68, 69, 70 is pivotably mounted. The braking rocker arms 69, 70 assigned to the braking mode have an identical rocker arm axis. The rocker arm mounting 76 comprises a mounting element 77 on which the rocker arms 68, 69, 70 are mounted. The mounting element 77 has ends that are oriented parallel to a rotational axis 78 of the exhaust camshaft 28 and used for mounting about a bearing axis 79, about which the mounting element 77 is pivotable.

The bearing axis 79 of the mounting element 77 is oriented parallel offset from the rotational axis 78 of the exhaust camshaft 28. The bearing axis 44 about which the mounting element 43 is pivotable, the bearing axis 79 about which the mounting element 77 is pivotable, the rotational axis 40 of the intake camshaft 10, and the rotational axis 78 of the exhaust camshaft 28 are disposed offset in parallel to one another. In the first end position of the rocker arm mounting 76, the exhaust cam follower 32 provided for the firing mode is in constant contact with the firing cam 29. In contrast, the braking exhaust cam followers 35, 36 provided for the braking mode are lifted off the braking cams 30, 31, whereby the braking cams 30, 31 pass beneath the corresponding braking exhaust cam follower 35, 36 without action (FIGS. 4 and 5). Conversely, in the second end position of the rocker arm mounting 76, the braking exhaust cam followers 35, 36 provided for the braking mode are in constant contact with the corresponding braking cam 30, 31, while the exhaust cam follower 32 provided for the firing mode is lifted off the firing cam 29, whereby the firing cam 29 passes beneath the exhaust cam follower 32 without action (FIGS. 3 and 6). The rocker arm mounting 76 is provided so as to be switched by way of the rotational movement of the exhaust camshaft 28. The bearing axis 79 of the mounting element 77 is operatively disposed between the rocker arm axis of the rocker arm 68 assigned to the firing mode and the rocker arm axes of the braking rocker arms 69, 70 assigned to the braking mode. So as to fix the rocker arm mounting 76, the switchover device 37 assigned to the exhaust camshaft 28 comprises a spring-loaded detent engagement element 80, which is provided to fix the rocker arm mounting 76 in the two end positions. The rocker arm mountings 25, 76 are designed analogously to one another, for which reason reference is made to the description of the rocker arm mounting 25 for the remaining description of the rocker arm mounting 76.

For the operative connection to the detent engagement element 80, the switchover device 37 assigned to the exhaust camshaft 28 comprises a detent contour element 81, against which the detent engagement element 80 is supported. The detent contour element 81 comprises a bearing axis 82 about which the detent contour element 81 is pivotable. The detent contour elements 51, 81 are designed analogously to one another, for which reason reference is made to the description of the detent contour element 51 for the remaining description of the detent contour element 81.

Figure 8:
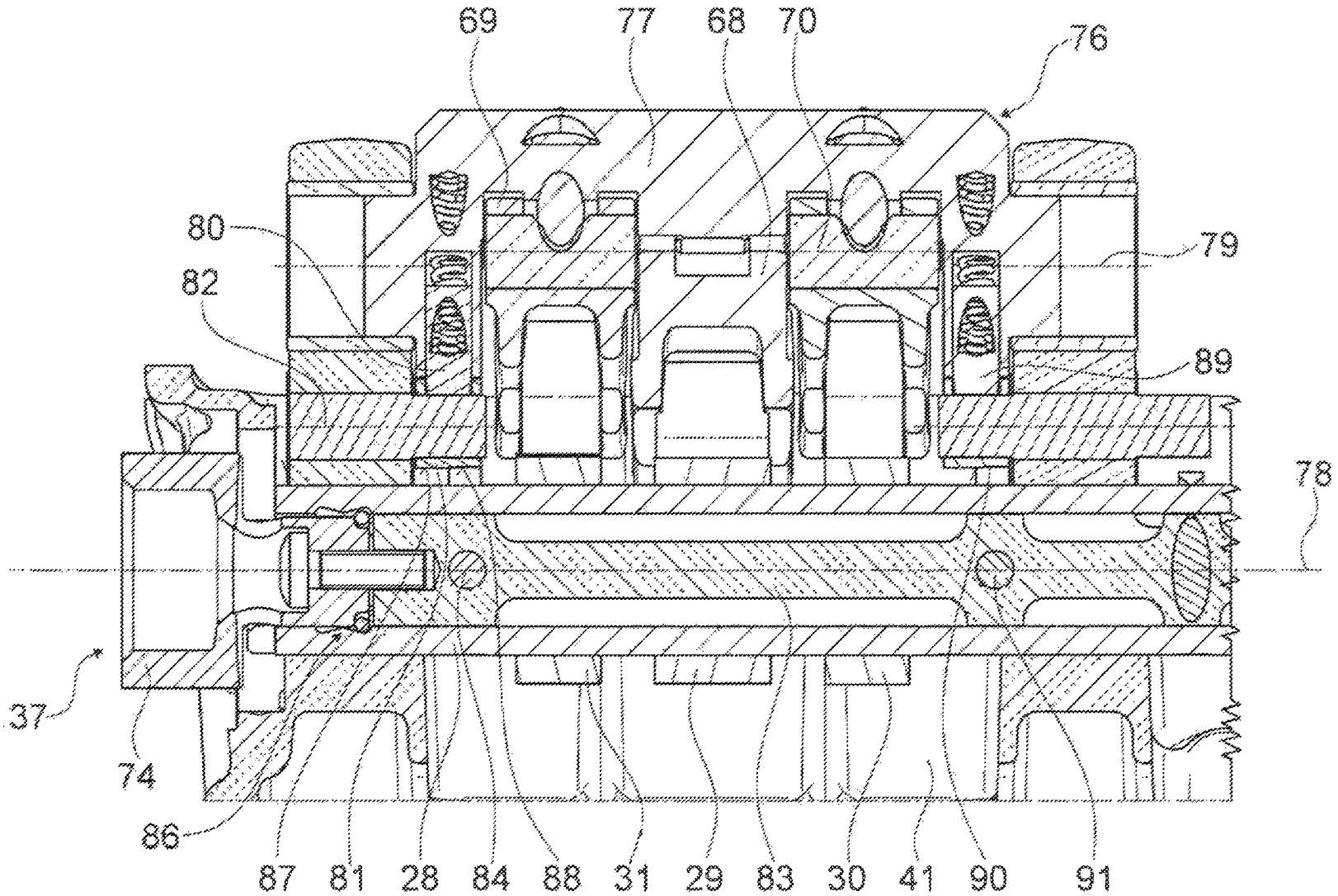
FIG. 8 shows a longitudinal section through an exhaust camshaft of the valve train device.

The gate element 74 axially protruding from the exhaust camshaft 28 is connected to a shift rod 83 that is axially displaceably accommodated in the exhaust camshaft 28 (see FIG. 8). When the shifting pin 75 engages in one of the slotted guide tracks of the gate element 74, the gate element 74 and the shift rod 83 are axially displaced along the rotational axis 78 of the exhaust camshaft 28. An actuating pin 84 is accommodated in the shift rod 83, the actuating pin radially protruding from the exhaust camshaft 28 through a longitudinal slot 85 (see FIG. 7). The actuating pin 84 is thus likewise displaced along the rotational axis 78 of the exhaust camshaft 28 during the axial displacement of the shift rod 83 in the longitudinal slot 85 thereof. The actuating pin 84 is provided for the purpose of transmitting the torque that is present on the exhaust camshaft 28 to the detent contour element 81 and to pivot the detent contour element 81 about the bearing axis 82 thereof by way of the torque. The gate element 74 connected to the shift rod 83 comprises a suitable detent device 86 with the exhaust camshaft 28, so that a corresponding position of the shift rod 83 in the exhaust camshaft 28 can be maintained for the braking mode or firing mode.

The detent contour element 81 has a side facing the exhaust camshaft 28 which forms an actuating contour for pivoting by way of the torque of the exhaust camshaft 28. The actuating contour has two tracks 87, 88, which are offset from one another along the rotational axis 78 of the exhaust camshaft 28. Depending on which shift position the gate element 74 is shifted to, the actuating pin 84 engages in the one track 87 of the actuating contour or in the other track 88 of the actuating contour. The length of a path by which the gate element 74 can be axially displaced corresponds to a distance between the tracks 87, 88 present in the actuating contour of the detent contour element 81. In relation to the rotational movement of the actuating pin 84 about the rotational axis 78 of the exhaust camshaft 28, the tracks 87, 88 are designed as inclined tracks. The actuating contour of the detent contour element 81 is provided for the purpose of translating the torque of the exhaust camshaft 28 acting on the actuating pin 84 into a torque acting on the detent contour element 81 so as to pivot the detent contour element 81 about the bearing axis 82 thereof.

In the shown exemplary embodiment, the switchover device 37 assigned to the exhaust camshaft 28 comprises a second detent engagement element 89 and a detent contour element 90, which are likewise switched by way of the gate element 74. For this purpose, the gate element 74 comprises a second actuating pin 91, which is provided for an operative connection with the second detent contour element 90. The two detent contour elements 81, 90 act in parallel.

The invention claimed is:

1. An engine brake device, comprising:

an intake camshaft which includes an intake cam group having a firing cam and a braking cam;

an intake cam follower that is assigned to the firing cam and actuates an intake valve in a firing mode;

a braking intake cam follower that is assigned to the braking cam and actuates the intake valve in a braking mode;

an intake switchover device that is assigned to the intake camshaft, the intake switchover device including a detent engagement element and a detent contour element having depressions into which the detent engagement element is biased, the intake switchover device translating a torque of the intake camshaft into a force pivoting the detent contour element for switching between the firing mode and the braking mode; and a first rocker arm associated with the intake cam follower and a second braking rocker arm associated with the braking intake cam follower which are both pivotable about a respective rocker arm axis for actuating the intake valve;

wherein the intake switchover device includes a rocker arm mounting that defines the respective rocker arm axes and has a first end position assigned to the firing mode and a second braking end position assigned to the braking mode and wherein the rocker arm mounting is switchable between the first end position and the second braking end position by way of the torque of the intake camshaft.

2. The engine brake device according to claim 1, wherein the intake switchover device includes a gate element that is non-rotatably but axially displaceably connected to the intake camshaft and has a slotted guide track which converts a rotational movement of the intake camshaft into a linear shifting movement of the gate element.

3. The engine brake device according to claim 1, wherein the braking cam has at least two intake elevations.

4. The engine brake device according to claim 1, wherein the second braking rocker arm actuates the first rocker arm.

5. The engine brake device according to claim 1, further comprising:

an exhaust camshaft which includes an exhaust cam group having an exhaust firing cam and an exhaust braking cam;

an exhaust cam follower that is assigned to the exhaust firing cam and actuates an exhaust valve in a firing mode;

a braking exhaust cam follower that is assigned to the exhaust braking cam and actuates the exhaust valve in a braking mode; and an exhaust switchover device that is assigned to the exhaust camshaft and translates a torque of the exhaust camshaft into a force for switching between the firing mode and the braking mode.

6. The engine brake device according to claim 5, wherein the exhaust switchover device and the intake switchover device are activatable independently from one another.

7. The engine brake device according to claim 5, wherein the exhaust cam follower that is assigned to the exhaust braking cam is a first exhaust cam follower, and the exhaust braking cam of the exhaust cam group is a first exhaust braking cam, wherein the engine brake device further comprises a second braking exhaust cam follower and a second exhaust braking cam, and wherein the second braking exhaust cam follower is assigned to the second exhaust braking cam and actuates a second exhaust valve in the braking mode.

8. The engine brake device according to claim 7, wherein the first exhaust braking cam and the second exhaust braking cam have differing exhaust cam curves.

* * * * *